US007083398B2

(12) United States Patent
Correale

(10) Patent No.: US 7,083,398 B2
(45) Date of Patent: Aug. 1, 2006

(54) VIBRATING PUMPING STAGE FOR MOLECULAR VACUUM PUMPS, AND MOLECULAR VACUUM PUMP WITH VIBRATING PUMPING STAGES

(75) Inventor: Raffaele Correale, Turin (IT)

(73) Assignee: Varian S.p.A., Turin (IT)

( * ) Notice: Subject to any disclaimer, the term of this patent is extended or adjusted under 35 U.S.C. 154(b) by 302 days.

(21) Appl. No.: 10/659,627

(22) Filed: Sep. 10, 2003

(65) Prior Publication Data

US 2004/0101422 A1 May 27, 2004

(30) Foreign Application Priority Data

Oct. 4, 2002 (IT) ..... TO2002A0859

(51) Int. Cl.
*F04B 17/00* (2006.01)

(52) U.S. Cl. ..... 417/413.3

(58) Field of Classification Search ..... 417/48, 417/50, 412, 413.1, 413.2
See application file for complete search history.

(56) References Cited

U.S. PATENT DOCUMENTS

| | | | | |
|---|---|---|---|---|
| 862,867 | A * | 8/1907 | Eggleston | 417/390 |
| 5,836,750 | A * | 11/1998 | Cabuz | 417/322 |
| 6,116,863 | A * | 9/2000 | Ahn et al. | 417/322 |
| 6,146,543 | A * | 11/2000 | Tai et al. | 216/2 |
| 6,168,395 | B1 * | 1/2001 | Quenzer et al. | 417/413.3 |
| 6,247,908 | B1 * | 6/2001 | Shinohara et al. | 417/413.2 |
| 6,351,054 | B1 * | 2/2002 | Cabuz et al. | 310/309 |

FOREIGN PATENT DOCUMENTS

EP 1 125 065 B1 7/2002

* cited by examiner

*Primary Examiner*—Charles G. Freay
*Assistant Examiner*—Samuel E. Belt
(74) *Attorney, Agent, or Firm*—Bella Fishman

(57) ABSTRACT

A micro-electro-mechanical vibrating pumping stage comprises a silicon substrate (15) on which there are formed a single-layer or multilayer oscillating assembly (27; 127; 227; 327) with a vibrating membrane and a device controlling the membrane in order to provide its oscillation with respect to the substrate. A molecular vacuum pump incorporates this vibrating pumping stage.

9 Claims, 3 Drawing Sheets

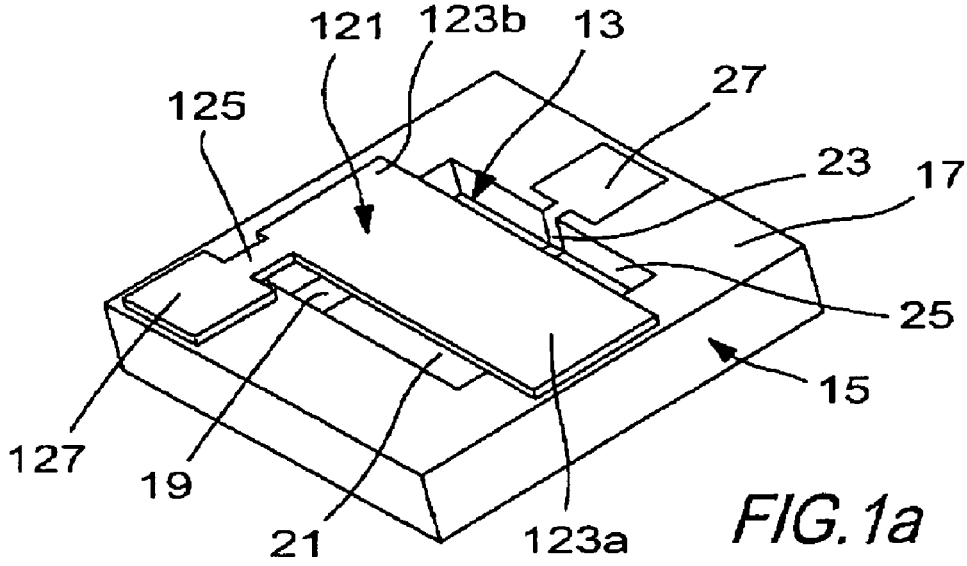
FIG. 1a
FIG. 1b
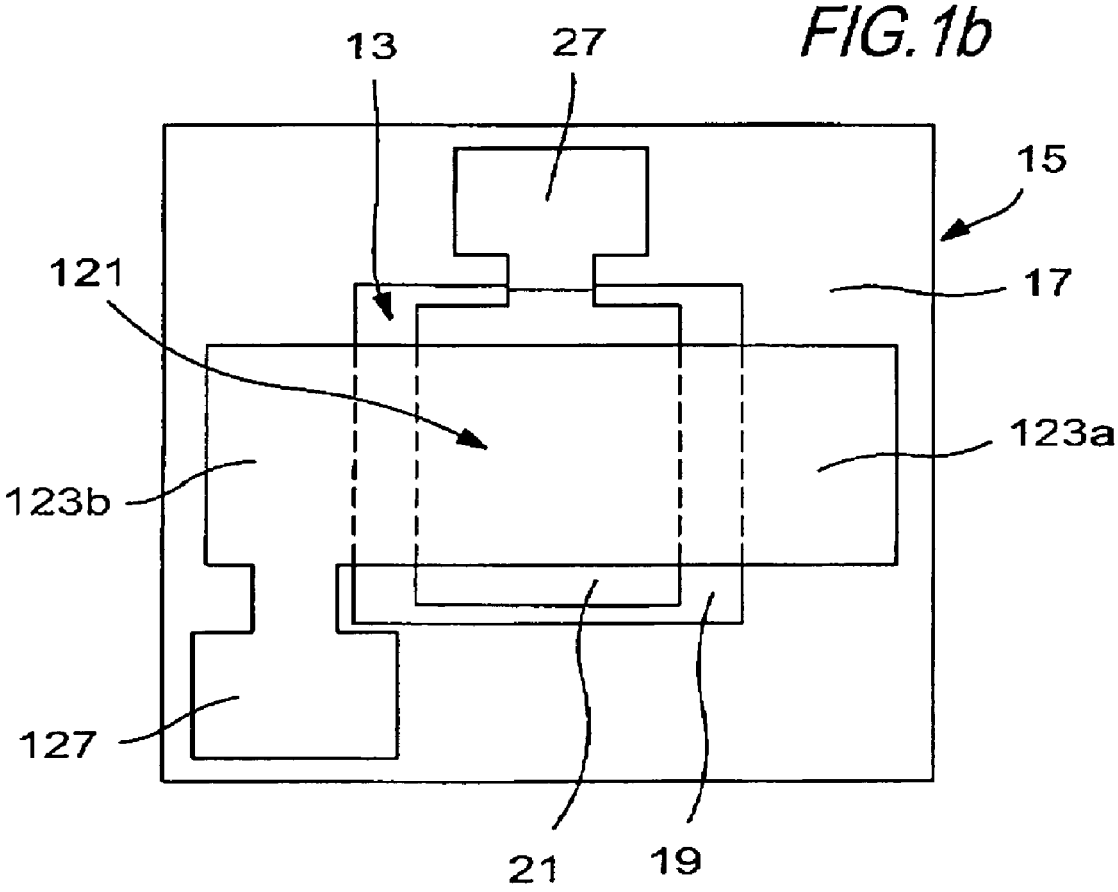

VIBRATING PUMPING STAGE FOR MOLECULAR VACUUM PUMPS, AND MOLECULAR VACUUM PUMP WITH VIBRATING PUMPING STAGES

FIELD OF THE INVENTION

The present invention relates to a vibrating pumping stage for vacuum pumps, and to a vacuum pump with vibrating pumping stages.

More precisely, the invention concerns a micro-electro-mechanical vibrating pumping stage, obtained by means of the technology used for manufacturing MEMS (Micro-Electro-Mechanical Systems).

The invention further concerns a molecular vacuum pump utilising vibrating MEMS pumping stages.

BACKGROUND OF THE INVENTION

A molecular vacuum pump equipped with vibrating members is disclosed, for example, in EP 1 125 065 by Vanden Brande, et al.

Vanden Brande, et al, teach manufacturing a molecular vacuum pump by arranging a set of alternated dipoles inside a box communicating on the one side with a chamber to be evacuated and on the other side with an outside environment, through a gas inlet port and a gas outlet port, respectively. Further according to the teaching of this patent, the dipoles are obtained by means of piezoelectric elements fastened to respective supports integral with the inner wall of said box.

However, the Vanden Brande, et al do not disclose the important details on the operation of the vibrating elements and on how to obtain in practice the desired pumping effect.

Some attempts to manufacture vacuum pumps by following their teachings have given unsatisfactory results. Particularly, the power required for operating a vacuum pump based on the disclosed principles has proven excessive with respect to the attainable results.

SUMMARY OF THE INVENTION

Thus, it is an object of the present invention to provide a micro-electro-mechanical pumping stage for vacuum pumps and a vacuum pump including one or more such stages, which stage and pump allow for obtaining industrially applicable results with competitive costs, and obtaining advantages in terms of pumping speed and compression ratio.

The above and other objects are achieved by the micro-electro-mechanical pumping stage and the vacuum pump as claimed in the appended claims.

Advantageously, according to the invention, the vibrating micro-electro-mechanical pumping stage is obtained by means of the technology known for developing MEMS (Micro-Electro-Mechanical Systems) devices.

As known, the term "MEMS" denotes those miniaturised electro-mechanical systems integrating mechanical components, sensors, drivers, and the related electronics, onto a silicon substrate. MEMS components are generally obtained through micro-machining processes that selectively etch silicon, by removing selected parts of the silicon wafer, or that add new structural layers, to form the mechanical and electro-mechanical component. Due to this technology, it has been possible to produce complete systems, such as micro-drivers, on a chip.

Advantageously, the technology for manufacturing MEMS utilises manufacturing methods similar to those used for integrated circuits, and thus it can benefit from similar levels of quality, reliability, sophistication and low cost typical of integrated circuits.

Hereinafter, some exemplary embodiments of the invention, given by way of non limiting example, will be described with reference to the accompanying drawings, in which:

BRIEF DESCRIPTION OF THE DRAWINGS

FIG. 1*a* is a top perspective view of a first embodiment of the pumping stage according to the invention;

FIG. 1*b* is a top plan view of the pumping stage shown in FIG. 1;

DETAILED DESCRIPTION OF THE INVENTION

Figure 2:
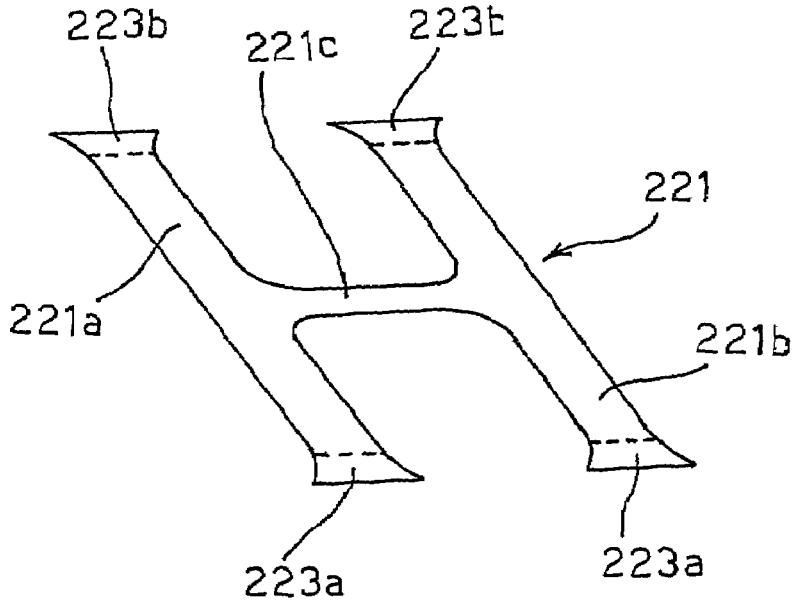
FIG. 2 is a perspective view of a second embodiment of the pumping stage according to the invention.

Referring to FIGS. 1*a* and 1*b*, there is shown a first embodiment of the micro-electro-mechanical pumping stage according to the invention.

According to that embodiment, a vibrating planar resilient membrane 121 is suspended above a cavity 13 formed in a supporting base 15.

Membrane 121 is of substantially rectangular shape and it is fastened to the peripheral rim surrounding cavity 13, formed on supporting base 15, at two rectangular fastening regions 123*a*, 123*b* adjacent to the minor sides of membrane 121.

The membrane 121 is further provided with a side extension 125 partly overlapping peripheral rim 17 so as to define a corresponding contact area 127.

Supporting base 15 preferably is a silicon substrate or wafer on which cavity 13 has been formed by conventional etching techniques.

A metal control electrode 21 is located inside cavity 13, in contact with bottom 19, and is provided with a side extension 23 bent against side wall 25 of cavity 13, which extension partly covers peripheral rim 17 of supporting base 15 and defines a corresponding contact area 27.

By applying a voltage signal to the areas 27, 127 in control electrode 21 and membrane 121, respectively, an electric field can be produced between control electrode 21 and membrane 121, whereby membrane 121 is attracted towards electrode 21.

If the voltage signal applied to contact areas 27, 127 is periodically interrupted, the vibration of membrane 21 will be obtained. In particular, if said signal is sinusoidal with frequencies different from the resonance frequency of membrane 121, membrane 121 will start vibrating at the signal frequency.

To obtain a pumping effect on the gas molecules by the vibrating membrane, the latter should be made to vibrate at very high speeds, typically of the order of the speed of the gas molecules to be pumped and hence close or equivalent to the membrane resonance speed.

In an exemplary embodiment, the voltage applied to the terminals consisting of contact areas 27, 127 in control electrode 21 and vibrating membrane 121, respectively, will be about 100 V.

Suitable materials for manufacturing membrane 121 may be aluminium, molybdenum, $SiO_2$, $Si_3N_4$, Si (single crystalline), the latter being preferable to obtain higher vibration speed of the membrane.

Moreover, membranes made of dielectric material, such as $SiO_2$ and $Si_3N_4$, will have a sandwich structure (dielectric-metal-dielectric) where a metal layer is sandwiched between two dielectric layers, so that membrane vibration can be controlled by the electric field.

Generally, short and thick membranes will move at higher speed and short and/or thick membranes will demand higher energy to cause the requested deflection on the molecules of the surrounding gas.

In an exemplary embodiment of the invention, membrane 121 may have a surface of 100 μm×20 μm and a thickness of 1 μm.

Moreover, membrane 121 shall have sufficiently broad fastening regions 123*a*, 123*b* to prevent the membrane from becoming detached from base 15 while vibrating. For instance, in case of membranes of 100 μm×20 μm×1 μm, the fastening regions will preferably have a surface of at least 20 μm×20 μm.

The size of control electrode 21 will preferably be such that attraction force on membrane 121 is applied to about 50% of the membrane surface, preferably over a length of 25 μm to 75 μm in the longitudinal direction of membrane 121 and over the whole width of membrane 121. The spacing between membrane 121 and control electrode 21 will preferably be in the range 5 μm to 15 μm depending on the material used and on the voltage applied to the contact areas of control electrode 21 and membrane 121.

Referring to FIG. 2, where elements identical to those shown in FIGS. 1*a* and 1*b* have been omitted, a second embodiment of the invention is shown in which the vibrating pumping stage is obtained by means of a planar, substantially H-shaped resilient membrane comprising two parallel longitudinal beams 221*a*, 221*b* and a transversal central beam 221*c*.

Similarly to the embodiment shown in FIGS. 1*a* and 1*b*, both parallel beams 221*a*, 221*b*, are fastened at their respective ends 223*a*, 223*b*, to peripheral rim 17 of supporting base 15. H-shaped membrane 221 is thus suspended above cavity 13 formed in supporting base 15.

Due to such a configuration, the H-shaped membrane may be imparted a torsional oscillation allowing attaining high resonance frequencies and great amplitudes.

Actually, torsional resonance frequency is much higher than the flexion one. For instance, an aluminium membrane 150 μm long, 15 μm wide and 1.5 μm thick will have the following resonance frequencies: flexion $3{,}5e^5$ Hz, torsion $2{,}0e^6$ Hz.

Deflection on the molecules of the surrounding gas caused by transversal beam 221*c* of H-shaped membrane 221 will thus be amplified with respect to the case of a single membrane submitted to flexion. Central transversal beam 221*c* should preferably be light and thin in order the resonance frequency of the assembly is not excessively reduced.

Figure 3:
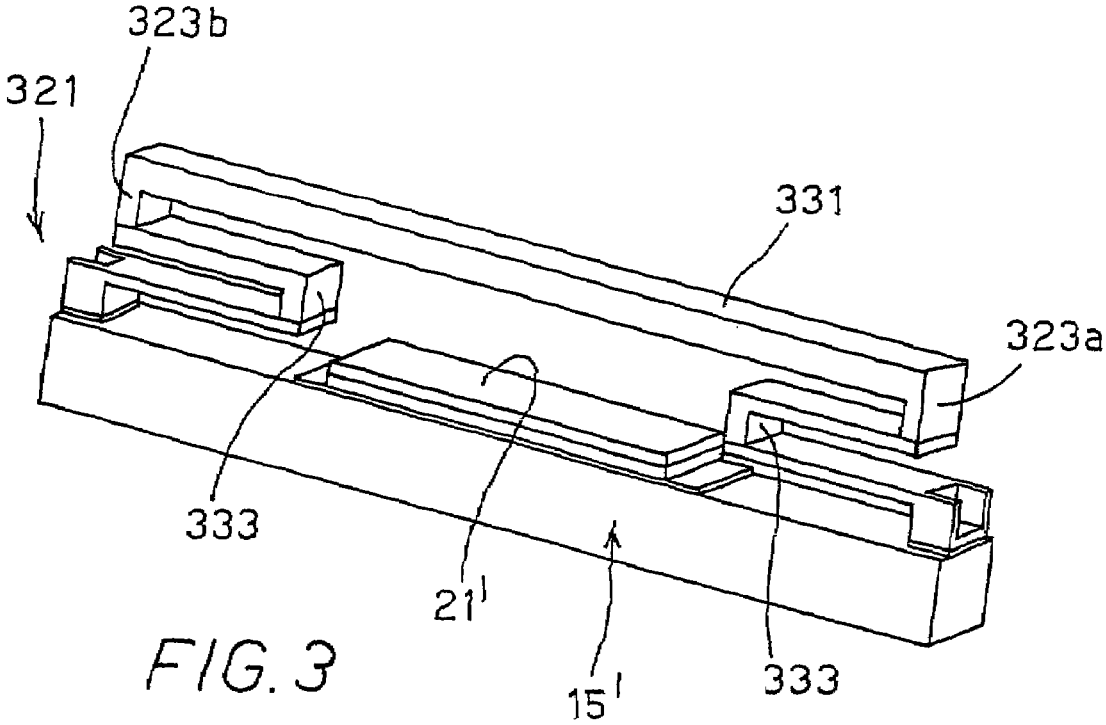
FIG. 3 is a perspective view of a third embodiment of the pumping stage according to the invention.

Referring now to FIG. 3, a third embodiment of the invention is shown in which a multilayer vibrating assembly 321 is provided.

According to this embodiment, assembly 321 comprises a substantially rigid membrane 331 supported by substantially S-shaped resilient members or suspension springs 333, located under membrane 331 at respective opposed ends 323*a*, 323*b* thereof.

Resilient members 333 will be in turn fastened to a rectilinear supporting base 15' onto which a control electrode 21' is provided to make assembly 321 vibrate due to the application of an electric field between the electrode 21' and membrane 331.

Figure 4:
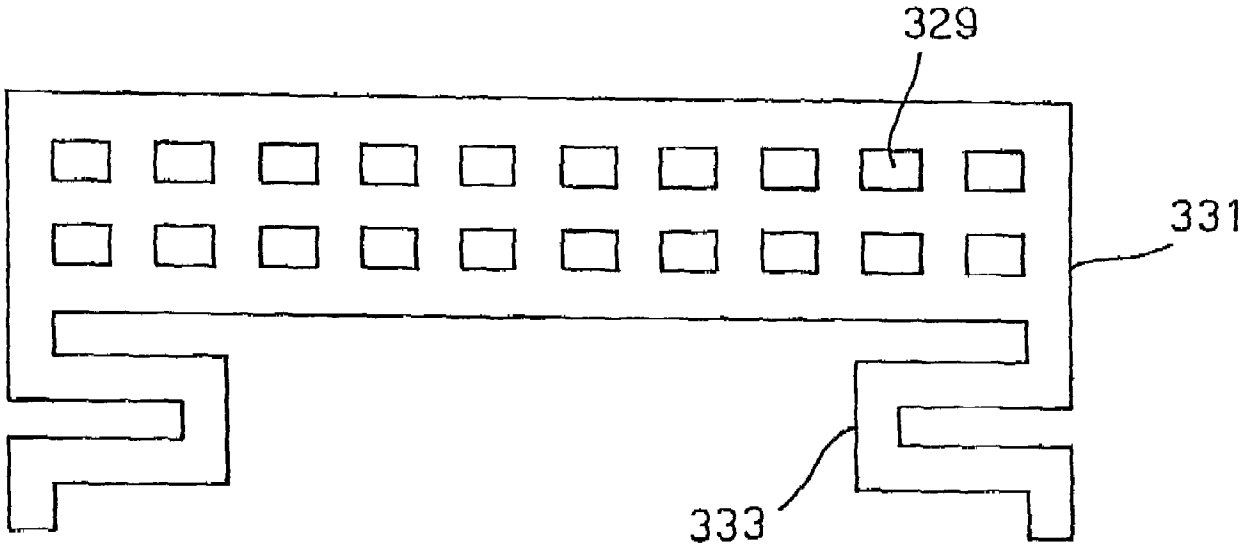
FIG. 4 is a front view of a fourth embodiment of the pumping stage according to the invention.

Referring to FIG. 4, which shows a fourth embodiment of the invention, membrane 331 may advantageously have openings 329 to provide a trellis structure with sufficient rigidity, so that the membrane may oscillate substantially parallel to the plane on which it lies in idle conditions.

With respect to the case of the simple membrane (FIGS. 1*a* and 1*b*) or the H-shaped membrane (FIG. 2), the multilayer configuration of the embodiments shown in FIGS. 3 and 4 will advantageously result in the whole surface of membrane 331 being active at the specified speed.

The membrane 331 remains substantially planar during oscillation and, consequently, the whole membrane surface will cause the same deflection on the gas molecules, contrary to what happens with both other configurations previously considered, where, because of the bending, only a limited portion of the membrane has an optimal deflection.

Advantageously therefore the multilayer assembly allows for attaining a high efficiency in terms of active vibrating surface, since the fastening areas are located below the oscillating surface.

In an exemplary embodiment, multilayer assembly 321 may have the following dimensions:

membrane thickness: 1 μm;
vibrating surface length: 15–25 μm;
spring length: 2–3 μm;
assembly thickness: 5 μm;
spring thickness: 0.5 μm.

Advantageously, according to the invention, vibrating pumping sets can be made by coupling a plurality of vibrating pumping stages like those described above. These pumping stages could for instance be arranged in a same plane to form different geometrical configurations with greater or smaller surfaces, for instance disc-shaped configurations, depending on the pumping capacity to be obtained. The spacing between the pumping stages could vary depending on the kind of vibrating assembly and could be of the order of a few micrometers, e.g. 3 μm.

Figure 5:
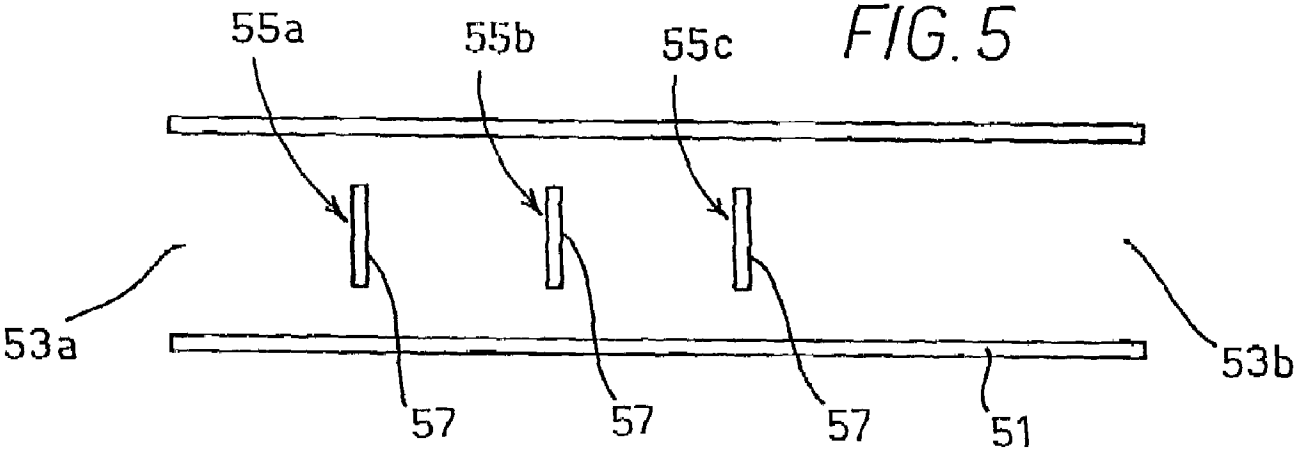
FIG. 5 is a diagrammatic view of a vacuum pump with vibrating pumping stages according to the invention.

Referring to FIG. 5, there is schematically shown a molecular vacuum pump including a plurality of micro-electro-mechanical vibrating pumping stages.

In FIG. 5, reference numeral 51 denotes a cylindrical casing inside which there are located pumping sets consisting of disc-shaped members 55*a*, 55*b*, 55*c* bearing a plurality of micro-electro-mechanical pumping stages made in accordance with one of the embodiments described with reference to the preceding Figures.

These disc-shaped pumping sets 55*a*, 55*b*, 55*c* have a smaller diameter than the internal diameter of cylindrical casing 51 so as to define a corresponding free annulus for letting gas flow between discs 55*a*–55*c* and the internal wall of casing 51.

The tubular casing 51 has a first end 53*a* and a second end 53*b*. The first end 53*a* corresponds to the inlet port for the gas to be pumped and could be connected to a chamber to be evacuated. The second end 53*b* corresponds to the gas outlet port and could be connected to the outside environment, preferably through a forepump.

According to the invention, corresponding vibrating surfaces 57 are defined on said disc-shaped members 55*a*, 55*b*,

55*c* and are obtained by placing side by side a plurality of vibrating pumping stages that move back and forth thereby causing the deflection of the gas molecules inside casing 51 and consequently the gas pumping towards outlet port 53*b*.

Advantageously moreover said pumping devices will be mutually electrically connected on disc-shaped member 55*a*, 55*b*, 55*c* in order to form an integrated unit from which only a pair of conductors for electric power supply comes out.

For an optimum operation of the vacuum pump thus obtained, the vibration speed of the vibrating surfaces will preferably be of the same order of magnitude as the thermal agitation speed of the molecules of the gas to be pumped through the pump.

The pumping action on the gas molecules by the vibrating surfaces is substantially given by the direction variation imparted to the molecule paths inside casing 51.

When the vibrating surface moves forth, i.e. towards gas outlet end 53*b*, it intercepts a greater amount of molecules, and when moving back, i.e. towards the inlet, it intercepts a smaller amount of molecules, with respect to a condition in which the surface is stationary.

That phenomenon results in an unbalance effect such that the forward projection effect is more accentuated than the backward defocusing effect, and a strong increase is obtained in the probability that the gas molecules are transmitted towards outlet 53*b*.

In a preferred embodiment, the molecular pump comprises multiple casings 51 housing a number of disc-shaped deflecting members 55 forming respective pumping units.

Moreover, each pumping unit 55 could be independently controlled and monitored through a control or "feed-back" device that, by measuring the pump performance, can vary the vibration speed and amplitude of the vibrating surfaces.

Advantageously, according to the proposed arrangement, integrated vacuum pumps could be provided inside the ducts for gas flow, thereby obtaining active ducts, which can take different and even non-rectilinear shapes and different lengths depending on the applications.

In the disclosed examples, the membrane vibration has been obtained by exploiting electrostatic forces to periodically move the membrane closer to an electrode integral with a stationary support. Yet, also electromagnetic fields could be used to move the membrane, such fields allowing creating greater forces.

Of course, different structures, geometries and material could be used to manufacture the membrane, the choice of the best configuration being determined by the kind of gas, the pumping rate and the compression ratio to be obtained.

What is claimed is:

1. A vibrating pumping stage for vacuum pumps, comprising:

a supporting base (15; 15'), comprising a silicon wafer;

a peripheral rim (17) formed on said supporting base;

a vibrating assembly (121; 221; 321) comprising a planar membrane fastened to said supporting base (15;–15') and having edge regions, and a side extension (125) overlapping said peripheral rim defining a first contact area (127), and a control device (21) disposed between said supporting base (15; 15') and said vibrating assembly to make said vibrating assembly vibrate, said control device (21) being an electrode housed within a cavity (13) surrounded by said peripheral rim (17), said electrode comprising a side extension (23) partly overlapping the peripheral rim defining a second contact area (27); wherein a variable electric field is applied between said electrode and said vibrating assembly to cause vibration of said vibrating assembly with respect to said supporting base, said electric field generated by a sinusoidal signal, which is applied to said first and second contact areas and said sinusoidal signal having a frequency close to the resonance frequency of said vibrating assembly.

2. The vibrating pumping stage as claimed in claim 1, wherein said planar membrane is resilient.

3. The vibrating pumping stage as claimed in claim 2, wherein said membrane is substantially H-shaped and said edge regions comprise its four ends (223*a*, 223*b*).

4. The vibrating pumping stage as claimed in claim 3, wherein said edge regions of said membrane is fastened to said supporting base along peripheral rim (17) surrounding said cavity (13), whereby said membrane is suspended above said cavity.

5. The vibrating pumping stage as claimed in claim 1, wherein said planar membrane is substantially rectangular and said edge regions comprise its ends (123*a*, 123*b*) corresponding to the minor sides of said rectangle.

6. The vibrating pumping stage as claimed in claim 1, wherein said planar membrane of said vibrating assembly comprises a rigid membrane (331) supported by resilient members or suspension springs (333), placed between said membrane (331) and said supporting base, said resilient members being fastened to said supporting base.

7. The vibrating pumping stage as claimed in claim 6, wherein said membrane and said supporting base have a substantially parallepipedal rectilinear shape.

8. The vibrating pumping stage as claimed in claim 7, wherein said resilient members are S-shaped.

9. The vibrating pumping stage as claimed in claim 7, wherein said membrane has openings (329) to form a sufficiently rigid trellis structure causing the membrane to vibrate substantially parallel to the plane on which it lies in idle conditions.

* * * * *